US009314688B2

(12) United States Patent
Kropp

(10) Patent No.: US 9,314,688 B2
(45) Date of Patent: Apr. 19, 2016

(54) STRUCTURE FOR A SYSTEM WITH SLIDING SURFACE ELEMENTS

(71) Applicant: CeramTec-ETEC GmbH, Lohmar (DE)

(72) Inventor: Eduard Kropp, Hennef (DE)

(73) Assignee: CeramTec-ETEC GmbH, Lohmar (DE)

( * ) Notice: Subject to any disclaimer, the term of this patent is extended or adjusted under 35 U.S.C. 154(b) by 0 days.

(21) Appl. No.: 14/394,218

(22) PCT Filed: Apr. 15, 2013

(86) PCT No.: PCT/EP2013/057831
§ 371 (c)(1),
(2) Date: Nov. 13, 2014

(87) PCT Pub. No.: WO2013/153231
PCT Pub. Date: Oct. 17, 2013

(65) Prior Publication Data

US 2015/0133228 A1 May 14, 2015

(30) Foreign Application Priority Data

Apr. 13, 2012 (DE) ..... 10 2012 007 336

(51) Int. Cl.
*A63C 19/10* (2006.01)
*E01C 13/12* (2006.01)

(52) U.S. Cl.
CPC ..... *A63C 19/10* (2013.01); *E01C 13/12* (2013.01); *A63C 2201/04* (2013.01)

(58) Field of Classification Search
CPC .... A63C 19/00; A63C 19/10; A63C 2201/04; E01C 13/00; E01C 13/12; F25C 3/00; F25C 3/04
USPC ..... 472/88–90; 434/253; 482/71
See application file for complete search history.

(56) References Cited

U.S. PATENT DOCUMENTS

| | | | | |
|---|---|---|---|---|
| 1,551,249 | A | 8/1925 | Held | |
| 3,363,583 | A * | 1/1968 | Greenberg | B61B 11/00 104/134 |
| 3,796,429 | A | 3/1974 | Johnston | |
| 4,394,173 | A | 7/1983 | Aste | |
| 6,508,717 | B2 | 1/2003 | Katayama | |
| 2002/0165034 | A1 | 11/2002 | Katayama | |

FOREIGN PATENT DOCUMENTS

| | | | |
|---|---|---|---|
| DE | 22 13 268 | A1 | 9/1973 |
| DE | 31 17 314 | A1 | 5/1982 |
| DE | 102 33 467 | A1 | 3/2004 |
| DE | 10 2004 023 086 | B4 | 3/2009 |
| DE | 10 2007 060 755 | A1 | 6/2009 |
| DE | 10 2008 020 439 | B3 | 10/2009 |

* cited by examiner

*Primary Examiner* — Kien Nguyen
(74) *Attorney, Agent, or Firm* — Norton Rose Fulbright US LLP

(57) ABSTRACT

A system with at least one sliding surface element (1), preferably as run-in track systems for ski jump system/ski jumps, wherein the height and/or the course of the sliding surface elements (14) has to be adjusted to any profile by spacer elements (30).

22 Claims, 4 Drawing Sheets

STRUCTURE FOR A SYSTEM WITH SLIDING SURFACE ELEMENTS

Figure 1:
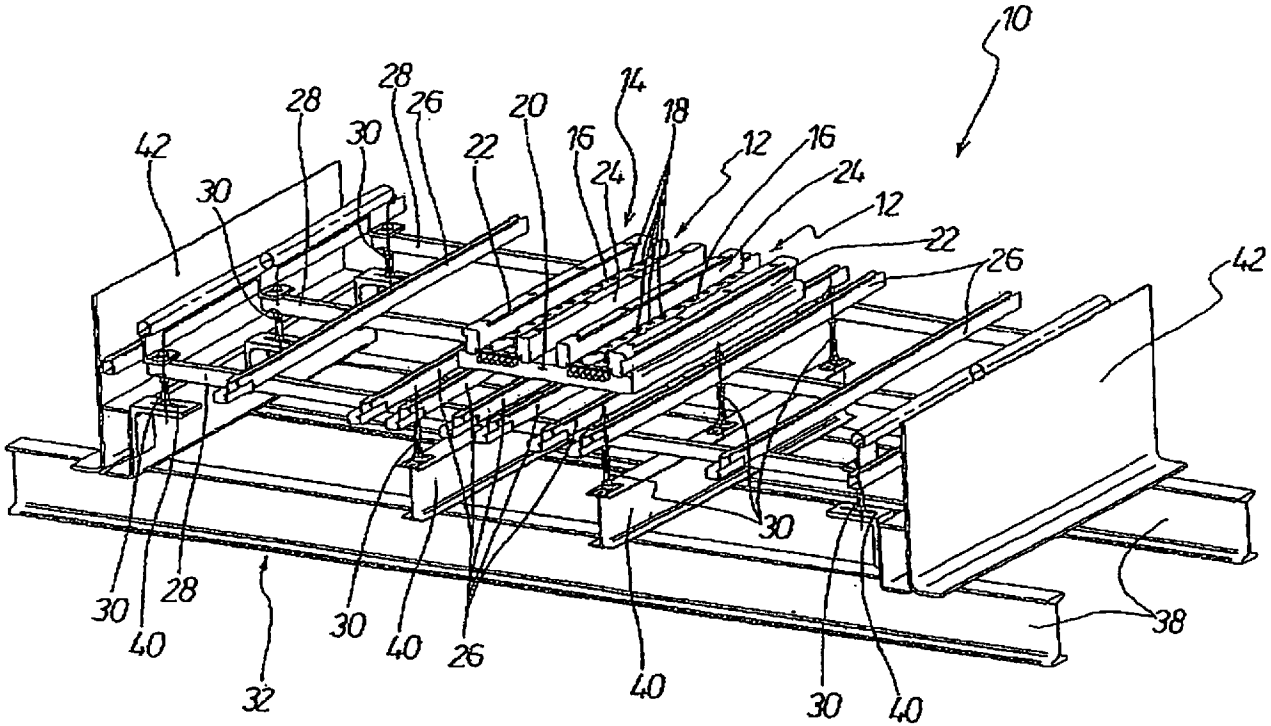

This application is a §371 of International Application No. PCT/EP2013/057831 filed Apr. 15, 2013, and claims priority from German Patent Application No. 10 2012 007 336.4 filed Apr. 13, 2012.

The invention relates to a structure for a system having at least one sliding surface element, preferably a structure for a system having sliding surface elements as run-up track systems for ski jump systems/ski jumps, particularly preferably a structure for a system having sliding surface elements as run-up track systems for ski jump systems/ski jumps in the form of two adjacent ski tracks extending in parallel to one another.

Such sliding surface elements are described, for example, in DE 102 33 467 A1, each having a base surface element made of a polymer material, in which nub bodies which protrude from the base surface element are fixed spaced apart from one another in a grid screen. The nub bodies are ceramic bodies. It is similarly possible that the nub bodies consist of another suitable abrasion-resistant material, such as steel or the like.

Sliding surface elements of the type mentioned at the outset are known, for example, from DE 10 2004 023086 B4, wherein a first strip element and, spaced apart from one another in the longitudinal center region, two second strip elements, are fastened on a rectangular substructure surface element along its two outer longitudinal edges in each case. The respective first strip element and the associated second strip element laterally delimit a ski track. A base surface element as described, for example, in above-cited DE 102 33 467 A1, is arranged on the substructure surface element, between the respective first strip element and the associated second strip element. The respective base surface element is provided on its top side with a drainage groove system.

DE 10 2007 060 755 A1 discloses a sliding surface element of the type mentioned at the outset, having a substructure surface element on which two first strip elements and two second strip elements are provided, wherein the respective first strip element and the associated second strip element laterally delimit a ski track. The substructure surface element has channels which are provided in the longitudinal direction of the sliding surface element. A coolant can be conducted through the longitudinal channels in order to ice over the ski tracks. However, it is also possible to conduct a temperature control medium through the longitudinal channels in order to heat the ski tracks as desired.

A sliding surface element of the type mentioned at the outset is also known, for example, from DE 10 2008 020 439 B3, having a substructure surface element, and two first strip elements and two second strip elements which laterally delimit a ski track in each case. The two second strip elements are provided with nozzle holes which are connectable to a spray water line and which open into the ski tracks. A TV camera device which is movable in the longitudinal direction or a cover is optionally attachable between the two strip elements.

The invention is based on the object of improving a structure of the type mentioned at the outset so that an adaptation of the system to any desired contour/any desired profile, for example, an adaptation to the so-called FIS profile applicable to ski jump systems, is always possible with ease and precision.

This object is achieved according to the invention by the features of claim 1, i.e., in that the course/the height of the sliding surface elements is to be adapted to an arbitrary contour/an arbitrary profile, using spacer elements. Spacer elements are easily and precisely attachable, and an adaptation to any desired contour/any desired profile is possible using them. "Height" is to be understood as the vertical distance of the structure from the part of the overall system which bears the sliding surface elements. The height of the sliding surface elements is therefore the vertical distance from a base unit fixed to the system. "Course of the sliding surface elements" means the horizontal and/or vertical alignment of the sliding surface elements.

In one preferred embodiment, the sliding surface elements are implemented as run-up track systems for ski jump systems/ski jumps, in the form of two adjacent ski tracks extending in parallel to one another. The spacer elements are situated between the base unit fixed to the system, the components of the overall system which bear the sliding surface elements, and the sliding surface elements. The sliding surface elements can be laid in one piece over the entire length of the system, or in the form of sliding surface element modules placed against one another. The base unit fixed to the system is a structure which is fixedly connected to the ski jump.

The sliding surface elements are preferably situated on first profile elements, which are arranged transversely with respect to the running direction of the sliding elements, the first transverse profile elements, wherein the spacer elements are provided between the first transverse profile elements and the base unit fixed to the system.

In an alternative embodiment, the sliding surface elements are situated on first profile elements arranged in parallel to the running direction of the sliding elements, the first longitudinal profile elements, wherein the spacer elements are provided between the first longitudinal profile elements and the base unit fixed to the system.

In one preferred embodiment, the sliding surface elements are situated on first longitudinal profile elements and the first longitudinal profile elements are situated on first transverse profile elements, wherein spacer elements which are variable in their longitudinal dimensions are provided between the first transverse profile elements and the base unit fixed to the system.

Due to this embodiment according to the invention having the first longitudinal profile elements and the first transverse profile elements, not only the height, but also the parallelism of the sliding surface elements and therefore the alignment of the ski tracks defined by the sliding surface elements, for example, in their longitudinal direction, are precisely settable and fixable in a simple and time-saving manner.

According to the invention, the base unit fixed to the system can have second transverse profile elements. These second transverse profile elements are situated on the stationary system substructure, which is a steel-concrete substructure, for example. Second longitudinal profile elements, from which the threaded bolts of the spacer elements protrude upwardly, are advantageously situated on the second transverse profile elements.

The first longitudinal profile elements and the first transverse profile elements are preferably formed by C profile elements. The second transverse profile elements are preferably formed by double-T profile elements. Other profile shapes are also usable, of course.

The second longitudinal profile elements associated with the sliding surface elements are preferably likewise formed by double-T profile elements. Other profile shapes are also possible.

The first transverse profile elements advantageously protrude laterally on both sides beyond the sliding surface elements, wherein the respective lateral protrusion can be provided for walkable surface elements. The walkable surface elements can be, for example, grating surface elements. These can be covered with webs made of an artificial turf or the like during the summer season, for example.

The second longitudinal profile elements are advantageously formed on the end sections of the first transverse profile elements, which are remote from one another, by bracket-type angled profile elements which are attached to lateral longitudinal profile elements which protrude slightly beyond the first longitudinal profile elements and the sliding surface elements. These lateral longitudinal profile elements are formed, for example, by sheet metal profile elements.

All shapes of profiles known per se to a person skilled in the art can be used for the profile elements, for example, C, S, T, U, and/or double-T profiles, as long as they have the required stability.

The spacer elements are preferably variable in their longitudinal dimensions. However, any type of spacer element which permits a height adjustment is possible. The spacer elements can be constructed in one part or multiple parts. They can be manufactured from a large variety of materials corresponding to the purpose, for example, from plastic, carbon, or metal, for example, steel. The selected materials must be able to bear the forces acting on them. The spacer elements can also be implemented as vertically-adjustable shock absorbers. Spacer elements can also be provided in the form of displaceable wedges.

By means of the spacer elements, which are variable in their length and therefore settable in their length, it is possible in a simple, reliable, time-saving, and precise manner to set the height of the sliding surface elements and, when the sliding surface elements are used as a run-up track system for ski jump systems, to thus set the height of the ski jumps, as desired to make an adaptation to the FIS profile, for example.

In the structure according to the invention of the system, the spacer elements are preferably formed by threaded bolts having nuts. The sliding surface elements and therefore the ski tracks are adapted with millimeter precision to any desired profile, to the FIS profile, for example, by means of the threaded bolts and the associated nuts.

In one embodiment of the invention, the first transverse profile elements do not protrude laterally beyond the sliding surface elements. In this way, only the middle region, i.e., the region having the sliding surface element(s), is vertically adjustable. The system is thus simpler to construct. However, a step can thus also result.

The longitudinal profile elements as well as the transverse profile elements can be produced from materials suitable for the purpose, for example from plastic, carbon, or steel, preferably galvanized black steel or stainless steel. Glass fiber-reinforced plastics may also be used. However, copper or wood are also conceivable. A coating of the profile elements can also be provided according to the invention.

The structure according to the invention for a system having a sliding surface element can also be provided for snowboard events.

A guide rail for a milling machine for a milling carriage, for example, is preferably situated on the edge of the structure according to the invention. This guide rail is preferably fastened to the first transverse profile elements.

Further details, features, and advantages result from the following description of one exemplary embodiment, illustrated in the drawing, of the ski jump structure according to the invention for a ski jump system, wherein it is understood that the invention is not restricted to the design shown in the drawing.

Figure 2:
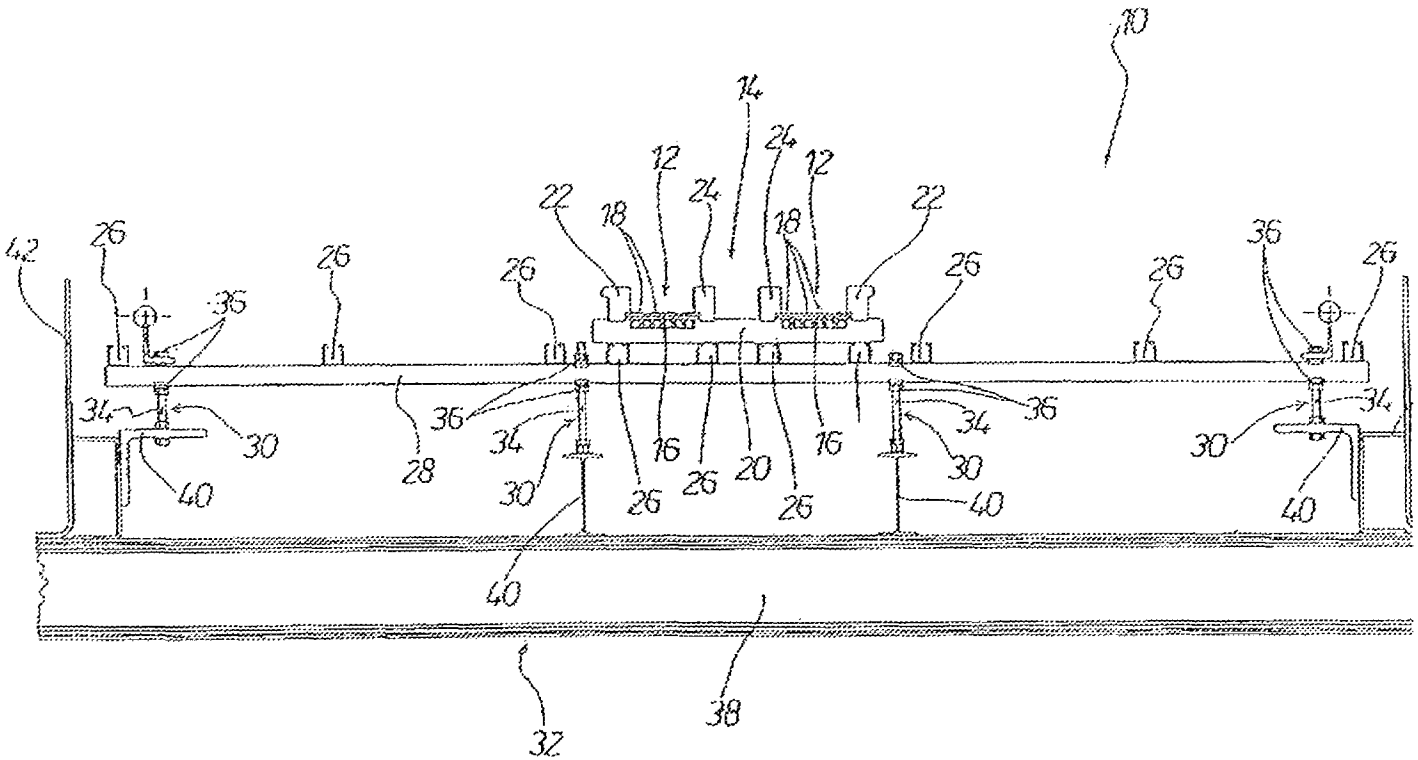
Figure 3:
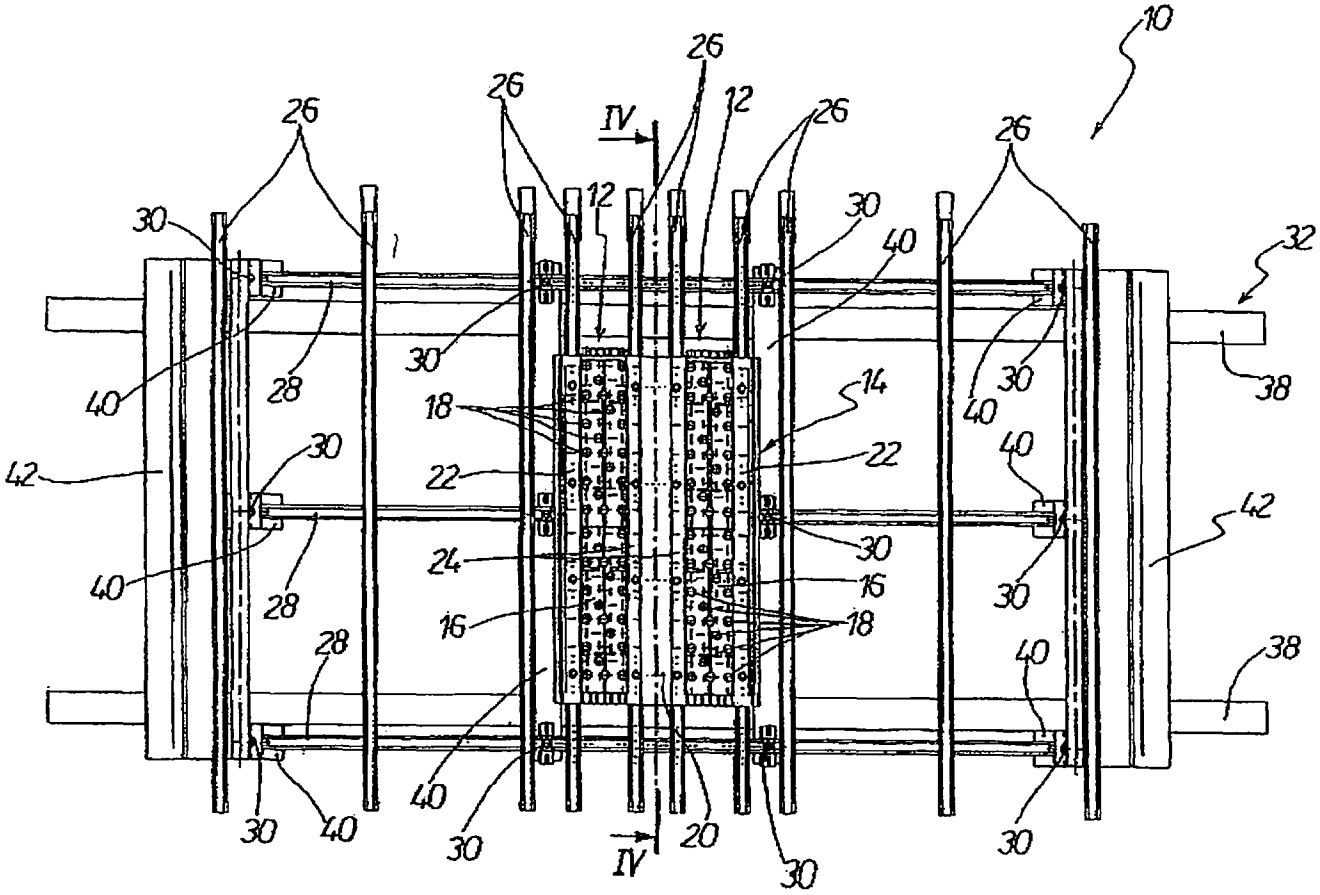
Figure 4:
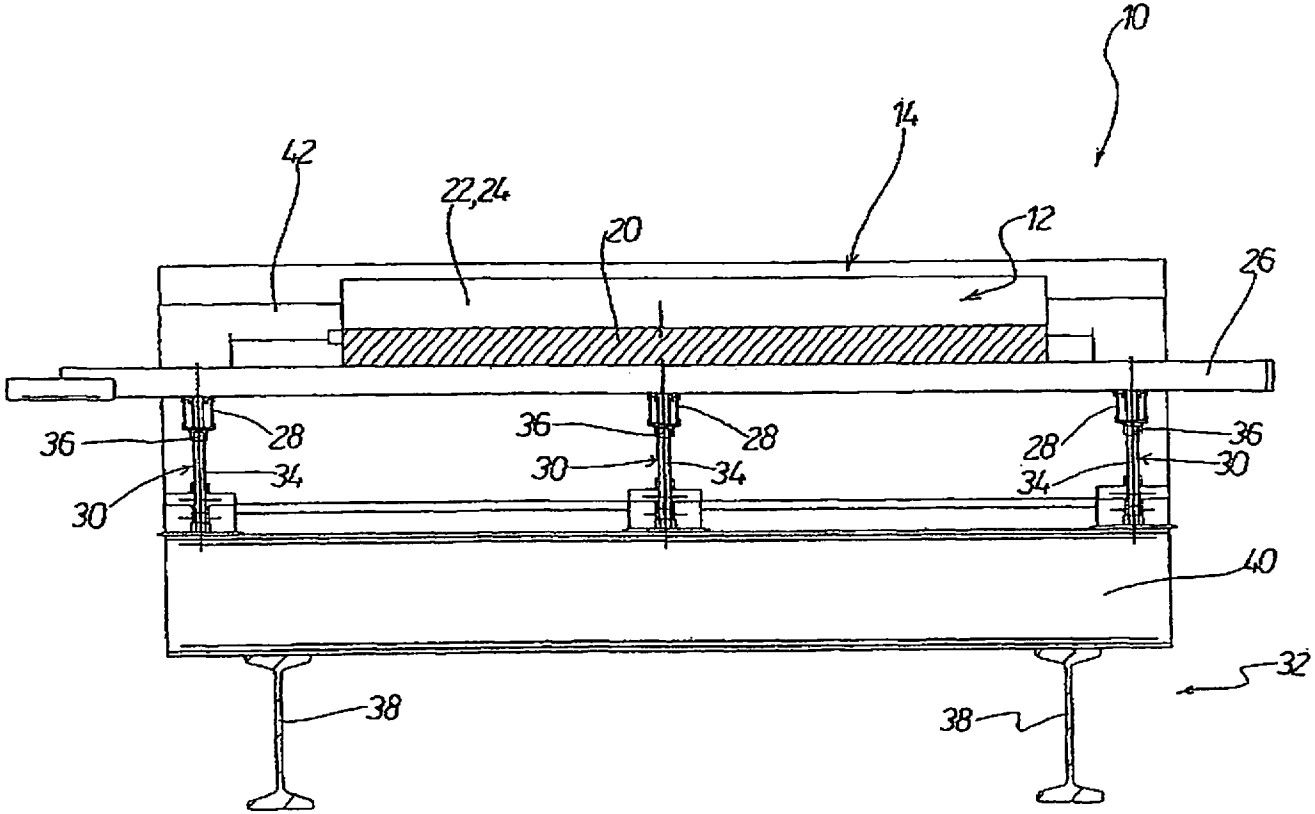

In the figures:

FIG. 1 shows a perspective view of a section of the structure according to the invention, FIG. 2 shows a front view of the structure according to FIG. 1, FIG. 3 shows a view of the structure according to FIG. 1 in the viewing direction from above, and FIG. 4 shows a section along section line IV-IV in FIG. 3.

FIGS. 1 to 4 illustrate an embodiment of the structure 10 for a ski jump system. The structure 10 has a pair of adjacent ski tracks 12 extending in parallel to one another, which are formed by sliding surface elements 14. The sliding surface elements 14 each have base surface elements 16 made of a polymer material, in which nub bodies 18 are fixed spaced apart from one another in a grid screen. The nub bodies 18, which are composed of ceramic material, metal, or the like, for example, protrude out of the base surface elements 16 in a defined manner. Preferably suited, for example, are nub bodies made of an oxide ceramic, such as aluminum oxide ceramic, or made of a carbide ceramic or nitride ceramic. However, the nub bodies can also be made of porcelain, plastic, or a combination of suitable materials.

The base surface elements 16 together with their nub bodies 18 are provided on a substructure surface element 20 of the respective sliding surface element 14. The base surface elements 16 are provided between a first strip element 22 and an associated second strip element 24. The corresponding ski track 12 is laterally delimited in a defined manner by the first strip element and the associated second strip element 22, 24, respectively.

Various implementations of sliding surface elements 14 are disclosed in the documents of the applicant cited at the outset, so that they do not need to be described in greater detail here.

The sliding surface elements 14 are situated on first longitudinal profile elements 26. The first longitudinal profile elements 26 are situated on first transverse profile elements 28. The first longitudinal profile elements 26 and the first transverse profile elements 28 are advantageously formed by C profile elements. Other profile shapes, i.e., profile cross sections, are also possible.

As is apparent from FIGS. 2 and 4, for example, spacer elements 30 which are variable in their longitudinal dimensions are provided between the first transverse profile elements 28 and a base unit 32 which is fixed to the ski jump. The spacer elements 30 have threaded bolts 34, having nuts 36, which protrude upwardly from the base unit 32.

The base unit 32 has second transverse profile elements 38. Second longitudinal profile elements 40, from which the threaded bolts 34 protrude upwardly, are situated on the second transverse profile elements 38. The second transverse profile elements 38 and the second longitudinal profile elements 40 are preferably formed by double-T profile elements. Other profile shapes, i.e., profile cross sections, can also be used, such as U profiles.

The first transverse profile elements 28 laterally protrude on both sides beyond the sliding surface elements 14. The respective lateral protrusion is provided for accommodating walkable surface elements (not shown), such as grid screen surface elements or the like.

The second longitudinal profile elements 40 at the end sections of the first transverse profile elements 28 which are remote from one another are not formed by double-T profile elements, but, rather, by bracket-type angled profile elements which are attached to lateral profile elements 42. The lateral profile elements 42 are formed, for example, by sheet metal profile elements which protrude slightly beyond the first longitudinal profile elements 22 and the sliding surface elements 14.

LIST OF REFERENCE NUMERALS

10 jump structure
12 ski tracks (of 10)
14 sliding surface element (of 10 for 12)
16 base surface element (of 14 for 18)
18 nub body (of 14)
20 substructure surface element (of 14)
22 first strip element (of 14)
24 second strip element (of 14)
26 first longitudinal profile element (of 10 for 14)
28 first transverse profile element (of 10 on 26)
30 spacer element (between 32 and 28)
32 base unit (of 10)
34 threaded bolt (of 30)
36 nut (on 34)
38 second transverse profile element (of 32)
40 second longitudinal profile element (of 32)
42 lateral profile element (of 10)

The invention claimed is:

1. A structure for a system having at least one sliding surface element, preferably as a run-up track system for ski jump systems/ski jumps, wherein at least one of the height or the course of the sliding surface elements is to be adapted to an arbitrary profile, using spacer elements; wherein the sliding surface elements are situated on first longitudinal profile elements, and the first longitudinal profile elements are situated on first transverse profile elements, wherein the spacer elements are provided between the first transverse profile elements and a base unit fixed to the system.

2. The structure according to claim 1, wherein the spacer elements are variable in their longitudinal dimensions.

3. The structure according to claim 2, wherein the spacer elements are situated between a base unit fixed to the system and the sliding surface elements.

4. The structure according to claim 2, wherein the sliding surface elements are situated on first transverse profile elements, which are arranged transversely with respect to the running direction of the ski track, wherein the spacer elements are provided between the first transverse profile elements and a base unit fixed to the system.

5. The structure according to claim 2, wherein the sliding surface elements are situated on first longitudinal profile elements, and the first longitudinal profile elements are situated on first transverse profile elements, wherein the spacer elements are provided between the first transverse profile elements and a base unit fixed to the system.

6. The structure according to claim 2, wherein the spacer elements have threaded bolts having nuts.

7. The structure according to claim 2, comprising a base unit which comprises second transverse profile elements.

8. The structure according to claim 2, wherein the structure further comprises second longitudinal profile elements, from which threaded bolts of the spacer elements protrude upwardly and are situated on the second transverse profile elements.

9. The structure according to claim 1, wherein the spacer elements are situated between a base unit fixed to the system and the sliding surface elements.

10. The structure according to claim 9, wherein the spacer elements are variable in their longitudinal dimensions.

11. The structure according to claim 1, wherein the sliding surface elements are situated on first transverse profile elements, which are arranged transversely with respect to the running direction of the ski track, wherein the spacer elements are provided between the first transverse profile elements and a base unit fixed to the system.

12. The structure according to claim 1, wherein the spacer elements have threaded bolts having nuts.

13. The structure according to claim 1, wherein the base unit has second transverse profile elements.

14. The structure according to claim 13, wherein second longitudinal profile elements, from which the threaded bolts of the spacer elements protrude upwardly, are situated on the second transverse profile elements.

15. The structure according to claim 13, wherein the second transverse profile elements associated with the sliding surface elements are formed by double-T profile elements.

16. The structure according to claim 1, wherein the first longitudinal profile elements and the first transverse profile elements are formed by C, U, S, T, double-T, or H profile elements.

17. The structure according to claim 1, wherein the structure further comprises second longitudinal profile elements which associated with the sliding surface elements are formed by C, U, S, T, double-T, or H profile elements.

18. The structure according to claim 1, wherein the first transverse profile elements do not protrude laterally beyond the sliding surface elements.

19. The structure according to claim 1, wherein the first transverse profile elements protrude laterally on both sides beyond the sliding surface elements, wherein the respective lateral protrusion is provided for walkable surface elements.

20. The structure according to claim 1, wherein the structure further comprises second longitudinal profile elements on the end sections of the first transverse profile elements which are remote from one another are formed by bracket-type angled profile elements which are attached to lateral profile elements which protrude slightly beyond the first longitudinal profile elements and the sliding surface elements.

21. A structure for a system having at least one sliding surface element, preferably as a run-up track system for ski jump systems/ski jumps, wherein the height of the sliding surface elements is to be adapted to an arbitrary profile, using spacer elements; wherein the sliding surface elements are situated on first longitudinal profile elements, and the first longitudinal profile elements are situated on first transverse profile elements, wherein the spacer elements are provided between the first transverse profile elements and the base unit fixed to the system.

22. A structure for a system having at least one sliding surface element, preferably as a run-up track system for ski jump systems/ski jumps, wherein the course of the sliding surface elements is to be adapted to an arbitrary profile, using spacer elements; wherein the sliding surface elements are situated on first longitudinal profile elements, and the first longitudinal profile elements are situated on first transverse profile elements, wherein the spacer elements are provided between the first transverse profile elements and the base unit fixed to the system.

* * * * *